US005752279A

United States Patent [19]

Hochmuth

[11] Patent Number: 5,752,279

[45] Date of Patent: May 19, 1998

[54] GOALKEEPER'S GLOVE WITH FINGER TIP CAP(S)

[76] Inventor: Peter Hochmuth, Weissenburger Str. 19, D-91757 Treuchtlingen, Germany

[21] Appl. No.: 785,260

[22] Filed: Jan. 17, 1997

[30] Foreign Application Priority Data

Jan. 19, 1996 [DE] Germany ..... 296 00 843.5

[51] Int. Cl.[6] ..... A41D 19/00

[52] U.S. Cl. ..... 2/161.1; 2/159; 2/169

[58] Field of Search ..... 2/161.1, 161.3, 2/161.6, 161.7, 159, 168, 169, 164, 167, 161.5

[56] References Cited

U.S. PATENT DOCUMENTS

| | | | |
|---|---|---|---|
| 3,386,104 | 6/1968 | Casey | 2/161.6 |
| 4,583,248 | 4/1986 | Edwards | 2/167 |
| 4,995,119 | 2/1991 | Cookind | 2/161.6 |
| 5,093,933 | 3/1992 | Berry | 2/161.6 |
| 5,136,725 | 8/1992 | Montero | 2/161.1 |

*Primary Examiner*—Gloria M. Hale

*Attorney, Agent, or Firm*—Anderson, Kill & Olick, P.C.

[57] ABSTRACT

A goalkeeper's glove, including inner and upper portions having respectively four inner and upper finger regions and inner and upper hand regions, each upper finger region being connected with a respective inner finger region along their lateral edges, with the outer end inner finger regions having, at a common free end thereof, a finger tip cap provided with an inner hat-shaped plastic compressible padding formed of a rubber material.

6 Claims, 1 Drawing Sheet

GOALKEEPER'S GLOVE WITH FINGER TIP CAP(S)

BACKGROUND OF THE INVENTION

1. Field of the Invention

The present invention relates to a goalkeeper's glove including un upper portion having four upper finger regions and an upper hand region, and an inner portion having four inner finger regions and an inner hand region, with each upper finger region being connected with a respective inner finger region along lateral edges thereof, and with each upper finger region forming, together with the respective inner finger region, at their common free end, a fingertip cap with at least one finger tip cap being provided with an elastic compressible padding.

2. Description of the Prior Art

A goalkeeper's glove of the above-described type is disclosed in German publication No. 4,241,261. In the goalkeeper's glove disclosed in this German publication, the phalanxes and finger tips are in a direct contact with the finger tip caps. As wear marks of an often used goalkeeper's glove show, the fingertip cap regions of a goalkeeper's glove are subjected to a particularly heavy lead, with a maximum abrasion in the cap region itself. Thus, the phalanxes and the finger tips of a goalkeeper likewise are subjected to a particular heavy load which is applied to the phalanxes and finger tip through the glove finger tip caps. Therefore, it is contemplated to provide the finger tip caps with paddings formed of cotton wool. The cotton wool compresses during the use of a glove and, with time, accumulates only at the very end of a finger tip.

Accordingly, an object of the present invention is a goalkeeper glove of the above-described type with a long-lasting padding for finger tips which would grasp a finger tip.

SUMMARY OF THE INVENTION

This and other objects of the present invention, which will become apparent hereinafter, are achieved by providing a padding having a shape of a hat and formed of a porous rubber-like material.

In a goalkeeper's glove according to the present invention, the padding grasps the goalkeeper's finger tip as a brimless hat and, thus, protects the entire finger tip. A hat shape can be easily formed of a porous rubber material, and it retains its shape and the elastic characteristics even with a lasting use of the glove. The padding according to the present invention can be used independent of whether an inner finger region and an associate outer finger regions are directly connected along their respective lateral edges or are connected by an appropriate layer strip or side strip, which is sewn, on one hand, to the inner finger region and, on the other hand, to the outer finger region.

According to the present invention, advantageously, all of the finger tip caps are provided with a hat-shaped padding. This substantially improves the use characteristics of a goalkeeper's glove.

When a thumb region of a goalkeeper's glove also has a finger tip cap, it is advantageous to also provide the thumb region finger cap with the inventive padding. Providing the thumb region finger tip cap with the inventive padding further improves the use characteristics of the goalkeeper's glove.

As a rubber-like material, a suitable foam plastic material can be used. However, it is advantageous to use a sponge rubber as a padding material. When the sponge rubber is used, long-lasting elastic compressibility is achieved. Moreover, with a sponge rubber, the hat-shape of the padding can be easily adapted to particular requirements which a particular glove should meet.

The hat-shaped paddings are pushed into their respective thumb and finger regions until they are firmly sit in respective finger tip caps. Advantageously, the paddings are glued to the finger tip cap. Gluing insures a firm positioning of a padding in a finger tip cap.

According to a preferred embodiment of the present invention, the padding has at an inner side of an associated finger region, a projection extending toward a hand region of the glove. The projection has a width which corresponds to the width of the associated finger region and a length corresponding to the length of the associated finger region.

According to a further preferred embodiment of the present invention, the padding has two side projections extending toward a hand region of the glove. Each of the side projections has a width approximately corresponding to the combined side width of both outer and inner finger regions, and a length which exceeds its width.

According to the invention, the circumferential dimension of the padding narrows toward the free end of the outer and inner finger regions.

BRIEF DESCRIPTION OF THE DRAWINGS

The objects and advantages of the present invention will become more apparent and the invention itself will be best understood from the following detailed description of the Preferred Embodiment, when read with reference to the accompanying drawings, wherein.

DETAILED DESCRIPTION OF THE PREFERRED EMBODIMENT

Figure 1:
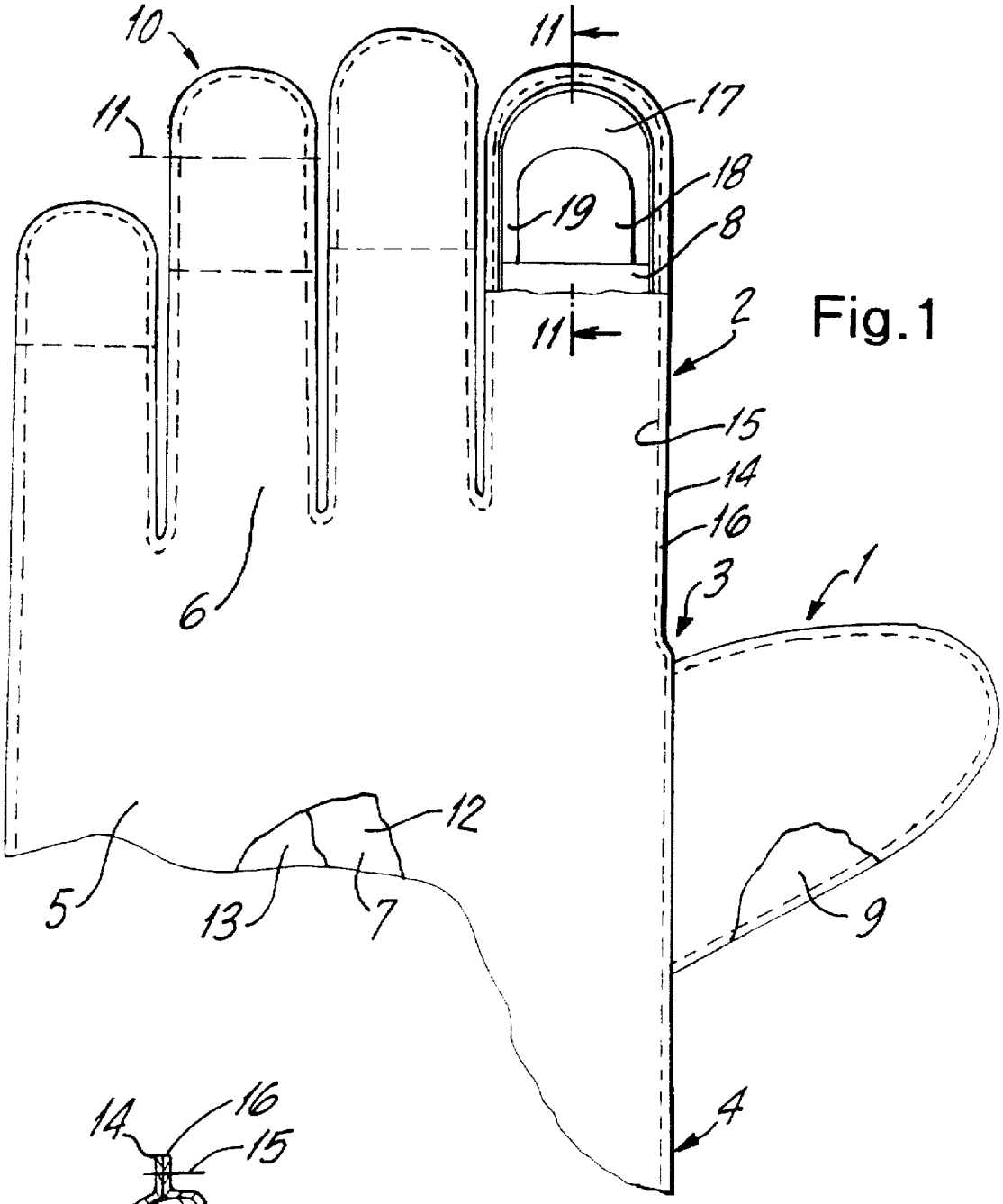
FIG. 1 shows a plan view of a goalkeeper's glove with fingertip paddings according to the present invention.

A goalkeeper's glove according to the present invention which is shown in the drawings, has a thumb region 1, four front finger regions 2, a hand region 3, and a wrist region 4. An upper wrist region, an upper hand region and four upper finger regions 6 form together a one-piece upper portion 5 of the glove. The inner hand region, four front inner finger regions 8, and an inner finger region 9 of the thumb region 1 form together a one-piece inner portion 7 of the glove. The upper portion 5 is superimposed on the inner portion 7. The tips of the front finger regions 2 and of the thumb region 1 define fingertip caps 10 the ends of which adjacent to the hand region 3 are marked with a dash line 11 (only one line 11 being shown). The inner portion 7 is formed of a carrier layer 12 with a superimposed outer latex layer 13. The four front finger regions 2 and the thumb region 1 are stitched along their respective lateral edges 14 with seams 15 so that ridge-like butts 16 are formed.

Figure 2:
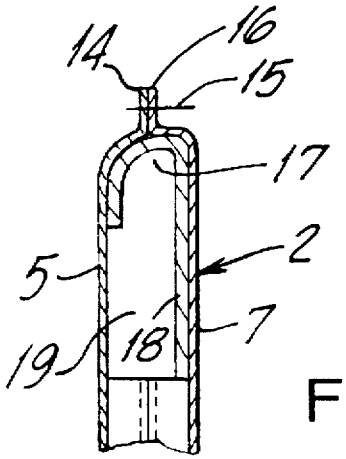
FIG. 2 shows a cross-sectional view along line II—II in FIG. 1.

In each fingertip cap of each finger region 2, there is provided a hat-shaped padding 17. The hat-shaped padding 17, which looks like a hat, is closed all around. The hat-shaped padding 17 is formed as a shaped piece which is additionally provided with a lower projection 18 and two side projections or extensions 19. As shown in FIG. 2, the external dimension of the hat-shaped padding 17 between the upper and inner portions of the glove narrows in the direction toward the free end of the finger region. That is, the padding 17 is adapted to the narrowing of the inner space of a finger region toward the free end of the finger region.

Though the present invention has been shown and described with reference to a preferred embodiment, such is merely illustrative of the present invention and is not to be construed as a limitation thereof, and the present invention includes all modifications, variations and/or alternate embodiments within the spirit and scope of the present invention as defined by the appended claims.

What is claimed is:

1. A goalkeeper's glove, comprising:

an upper portion having four upper finger regions and an upper hand region; and an inner portion having four inner finger regions and an inner hand region, wherein each upper finger region is connected with a respective inner finger region along lateral edges thereof, and each upper finger region and each inner finger region form, respectively, together a common free end having a fingertip cap, and wherein at least one fingertip cap is provided with a hat-shaped elastically compressible padding formed of one of a porous rubber material and a sponge rubber material, and wherein the padding has two side projections extending toward a hand region, each of the two side projections having a width corresponding substantially to a combined side width of the upper and inner finger regions, and a length exceeding the width thereof.

2. A goalkeeper's glove as set forth in claim 1, wherein all four finger tip caps are provided with a hat-shaped elastically compressible padding formed the one of a porous rubber material and sponge rubber material.

3. A goalkeeper's glove as set forth in claim 1, further comprising a thumb region provided at a free end thereof with a finger tip cap provided with a hat-shaped elastically compressible padding formed of the one of a porous rubber material and sponge rubber material.

4. A goalkeeper's glove as set forth in claim 1, wherein the padding is glued to the finger tip cap.

5. A goalkeeper's glove as set forth in claim 1, wherein the padding has, at an inner side of an associated finger region, a projection extending toward the hand region, the projection having a width corresponding to a width of the associated finger region and a length corresponding to a length of the associated finger region.

6. A goalkeeper's glove as set forth in claim 1, wherein an external dimension of the padding between the upper and inner portions of the glove narrows toward a free end of a finger region.

* * * * *